US006911054B2

(12) United States Patent
Boeckh et al.

(10) Patent No.: US 6,911,054 B2
(45) **Date of Patent: *Jun. 28, 2005**

(54) USE OF CATIONICALLY MODIFIED, PARTICLE-SHAPED, HYDROPHOBIC POLYMERS AS ADDITION AGENTS IN RINSING, CARE, DETERGENT AND CLEANING PRODUCTS

(75) Inventors: Dieter Boeckh, Limburgerhof (DE); Ralf Nörenberg, Büttelborn (DE); Jürgen Detering, Limburgerhof (DE); Werner Bertleff, Viernheim (DE); Holger Schöpke, Neckargemünd (DE); Reinhold J. Leyrer, Dannstadt (DE); Jürgen Huff, Ludwigshafen (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 186 days.

This patent is subject to a terminal disclaimer.

(21) Appl. No.: 10/296,229

(22) PCT Filed: Jun. 2, 2001

(86) PCT No.: PCT/EP01/06311

§ 371 (c)(1),
(2), (4) Date: Dec. 4, 2002

(87) PCT Pub. No.: WO01/94515

PCT Pub. Date: Dec. 13, 2001

(65) Prior Publication Data

US 2004/0077517 A1 Apr. 22, 2004

(30) Foreign Application Priority Data

Jun. 6, 2000 (DE) ..... 100 27 636

(51) Int. Cl.[7] ..... D06M 13/322; D06M 13/46; D06L 1/02; C11D 3/26; C11D 3/37

(52) U.S. Cl. ..... 8/181; 8/188; 8/137; 510/275; 510/327; 510/330; 510/350; 510/433; 510/504; 134/25.2; 134/25.3; 134/39; 134/42

(58) Field of Search ..... 510/275, 327, 510/330, 350, 433, 504; 8/181, 188, 137; 134/25.2, 25.3, 39, 42

(56) References Cited

U.S. PATENT DOCUMENTS

| | | | |
|---|---|---|---|
| 3,580,853 | A | 5/1971 | Parran |
| 3,993,830 | A | 11/1976 | Dickson et al. |
| 4,746,455 | A | 5/1988 | Matsuda et al. |
| 5,476,660 | A | 12/1995 | Somasundaran et al. |
| 2003/0171246 | A1 | 9/2003 | Boeckh et al. |
| 2003/0195135 | A1 | 10/2003 | Boeckh et al. |
| 2004/0171515 | A1 | 9/2004 | Hamers et al. |

FOREIGN PATENT DOCUMENTS

| | | |
|---|---|---|
| EP | 0 372 427 | 6/1990 |
| WO | 89 03669 | 5/1989 |
| WO | 99 19440 | 4/1999 |
| WO | 99 27065 | 6/1999 |

OTHER PUBLICATIONS

U.S. Appl. No. 10/479,983, filed Dec. 15, 2003, Hamers et al.
U.S. Appl. No. 10/296,229, filed Dec. 4, 2002, Boeckh et al.
U.S. Appl. No. 10/296,231, filed Dec. 4, 2002, Boeckh et al.
U.S. Appl. No. 10/296,221, filed Dec. 3, 2002, Boeckh et al.
M. Siddiq et al.: "Dissolution behaviour of model alkali–soluble emulsion polymers: effects of molecular weights and ionic strength" Colloid Polym. Sci., vol. 277, pp. 1172–1178, Feb. 1999.
H. Logemann et al.: "Allegemeines zur polymerisation in heterogener phase" Methoden Der Organischen Chemie, vol. 14, pp. 192–208 and 411–420 1961, not translated.
"Cationic Surfactants", Electronic Release, Chapter 8 Ullmann's Encyclopedia of Industrial Chemistry, 6$^{th}$ Edition 2000, no month given.

*Primary Examiner*—Brian P. Mruk
(74) *Attorney, Agent, or Firm*—Oblon, Spivak, McClelland, Maier & Neustadt, P.C.

(57) ABSTRACT

Use of cationically modified, particulate, hydrophobic polymers, the surface of which has been cationically modified by coating with polyvalent metal ions and/or cationic surfactants, the particle size of which is 10 nm to 100 $\mu$m, as additive to rinse compositions, care compositions, detergents and cleaners, and also rinse compositions, care compositions, detergents and cleaners which comprise the cationically modified, particulate, hydrophobic polymers.

21 Claims, No Drawings

USE OF CATIONICALLY MODIFIED, PARTICLE-SHAPED, HYDROPHOBIC POLYMERS AS ADDITION AGENTS IN RINSING, CARE, DETERGENT AND CLEANING PRODUCTS

The invention relates to the use of cationically modified, particulate, hydrophobic polymers as additive to rinse compositions, care compositions, detergents and cleaners, and also to rinse compositions, care compositions, detergents and cleaners which comprise the cationically modified, particulate, hydrophobic polymers.

Dispersions of particles of hydrophobic polymers, in particular aqueous dispersions of synthetic polymers and of waxes are used in the art to modify the properties of surfaces. For example, aqueous dispersions of finely divided hydrophobic polymers are used as binders in paper coating slips for the coating of paper or as paints. The dispersions applied in each case to a substrate in accordance with customary methods, e.g. by knife-coating, painting, saturation or impregnation, are dried. During drying, the dispersely divided particles form a coherent film on the respective surface.

Aqueous washing, rinsing, cleaning and care processes are, by contrast, usually carried out in a heavily diluted liquor, where the ingredients of the formulation applied in each case do not remain on the substrate, but instead are disposed of with the wastewater. The modification of surfaces using dispersed hydrophobic particles is possible in the processes given above only to an entirely unsatisfactory degree. Thus, for example, U.S. Pat. No. 3,580,853 discloses a detergent formulation which comprises a water-insoluble finely divided substance, such as biocides and certain cationic polymers which increase the deposition and retention of the biocides on the surfaces of the ware.

Furthermore U.S. Pat. No. 5,476,660 discloses the principle of using polymeric retention agents for cationic or zwitterionic dispersions of polystyrene or wax which comprise an active substance embedded within the dispersed particles. These dispersed particles are referred to as "carrier particles" because they adhere to the treated surface, where they liberate the active substance, e.g. upon use in surfactant-containing formulations.

From U.S. Pat. No. 3,993,830 it is known to apply a nonpermanent soil repellant finish onto a textile ware by treating the textile ware with a dilute aqueous solution which comprises a polycarboxylate polymer and a water-soluble salt of a polyvalent metal. Suitable polycarboxylate polymers are, preferably, water-soluble copolymers of ethylenically unsaturated monocarboxylic acids and alkyl acrylates. The mixtures are used for domestic textile washing in the rinse cycle of the washing machine.

It is an object of the present invention to provide a further method for the modification of surfaces.

We have found that this object is achieved according to the invention using cationically modified, particulate, hydrophobic polymers, the surface of which has been cationically modified by coating with polyvalent metal ions and/or cationic surfactants, and the particle size of which is 10 nm to 100 μm, as additive to rinse compositions, care compositions, detergents and cleaners.

The cationically modified, particulate, hydrophobic polymers are obtainable, for example, by treating aqueous dispersions of particulate, hydrophobic polymers having a particle size of from 10 nm to 100 μm with an aqueous solution of polyvalent metal salts, an aqueous solution of a cationic surfactant or mixtures thereof. This is carried out most simply by combining an aqueous dispersion of particulate, hydrophobic polymers having a particle size of from 10 nm to 100 μm with an aqueous solution of a water-soluble metal salt or a surfactant. In most cases, the two components are mixed at room temperature, although the mixing can also be carried out at temperatures of, for example, 0° to 100° C., provided that the dispersions do not coagulate upon heating. The dispersions of the particulate, hydrophobic polymers can be stabilized using an anionic emulsifier or protective colloid. Other dispersions which can be used with equal success are free from protective colloids and emulsifiers and comprise, however, as hydrophobic polymers, copolymers which contain, in copolymerized form, at least one anionic monomer. Such dispersions of copolymers having anionic groups can optionally additionally comprise an emulsifier and/or a protective colloid. Preference is given here to using anionic emulsifiers and/or protective colloids.

During the treatment of the anionically adjusted dispersions of the hydrophobic polymers with an aqueous solution of a polyvalent metal salt and/or a cationic surfactant, the charge of the originally anionically dispersed particles is reversed, meaning that, following the treatment, they preferably carry a cationic charge. Thus, for example, cationically modified dispersions of particulate hydrophobic polymers have, in 0.1% strength by weight aqueous dispersion, an interface potential of from −5 to +50 mV, preferably from −2 to +25 mV, in particular from 0 to +15 mV. The interface potential is determined by measuring the electrophoretic mobility in dilute aqueous dispersion and the pH of the designated use liquor.

The pH of the aqueous dispersion of the cationically modified, particulate, hydrophobic polymers is, for example, 1 to 12 and is preferably in the range from 2 to 10, in particular in the range from 2.5 to 8. In the case of the use of particles of polymers containing more than 10% by weight of anionic monomers, the pH of the aqueous dispersions is 1 to 7.5, preferably 2 to 5.5, in particular 2.5 to 5.

The hydrophobic polymers to be used according to the invention are insoluble in water at the application pH. They are present therein in the form of particles having an average particle size of from 10 nm to 100 μm, preferably 25 nm to 20 μm, particularly preferably 40 nm to 2 μm and in particular 60 to 800 mm, and can be obtained from the aqueous dispersions as powders. The average particle size of the hydrophobic polymers can be determined, for example, under the electron microscope or using light-scattering experiments.

A preferred embodiment of particles of the hydrophobic polymers to be used according to the invention display pH-dependent solubility and swelling behavior. At a pH below 6.5, particularly below 5.5 and in particular below 5, the particles are water-insoluble and retain their particulate character upon dispersion in concentrated and in dilute aqueous media. In contrast, hydrophobic polymer particles which contain carboxyl groups swell in water under neutral and alkaline conditions. This behavior of hydrophobic polymers having anionic groups is known from the literature, cf. M. Siddiq et al., who, in Colloid. Polym. Sci. 277, 1172–1178 (1999), report on the behavior of particles of methacrylic acid/ethyl acrylate copolymers in an aqueous medium.

Hydrophobic polymers are obtainable, for example, by polymerization of monomers from the group of alkyl esters of C3 to C5 monoethylenically unsaturated carboxylic acids and monohydric C1- to C22-alcohols, hydroxyalkyl esters of C3 to C5 monoethylenically unsaturated carboxylic acids and divalent C2- to C4-alcohols, vinyl esters of saturated C1- to C18-carboxylic acids, ethylene, propylene, isobutylene, C4 to C24-α-olefins, butadiene, styrene, α-methylstyrene, acrylonitrile, methacrylonitrile, tetrafluoroethylene, vinylidene fluoride, fluoroethylene, chlorotrifluoroethylene, hexafluoropropene, esters and amides of $C_3$–$C_5$-monoethylenically unsaturated carboxylic acids with amines or alcohols containing perfluoroalkyl groups, allyl and vinyl esters of carboxylic acids containing perfluoroalkyl groups or mixtures thereof. Here, the polymers may be homopolymers or copolymers.

Examples of hydrophobic copolymers are copolymers of ethyl acrylate and vinyl acetate, copolymers of butyl acrylate and styrene, copolymers of (meth)acrylic esters of the perfluoroalkyl-substituted alcohols of the formula $CF_3$—$(C_2F_4)_n$—$(CH_2)_m$—OH or $C_2F_5$—$(C_2F_4)_n$—$(CH_2)_m$—OH (n=1–10, m=0–10) with (meth)acrylic esters and/or (meth) acrylic acid, copolymeres of ethylene and tetrafluoroethylene, and copolymers of butyl acrylate and vinyl acetate. Said copolymers can contain the monomers in copolymerized form in any ratios.

The anionic character of the polymers mentioned can be achieved, for example, by polymerizing the monomers on which the copolymers are based in the presence of small amounts of anionic monomers, such as acrylic acid, methacrylic acid, styrenesulfonic acid, acrylamido-2-methylpropanesulfonic acid, vinyl sulfonate and/or maleic acid and optionally in the presence of emulsifiers and/or protective colloids.

The anionic character of the polymers mentioned can, however, also be achieved by carrying out the copolymerization in the presence of anionic protective colloids and/or anionic emulsifiers.

The anionic character of the polymers mentioned can, however, also be achieved by emulsifying or dispersing the finished polymers in the presence of anionic protective colloids and/or anionic emulsifiers.

Hydrophobic polymers contain, for example, (a) 40 to 100% by weight, preferably 50 to 90% by weight, particularly preferably 60 to 75% by weight, of at least one water-insoluble nonionic monomer, (b) 0 to 60% by weight, preferably 1 to 55% by weight, particularly preferably 5 to 50% by weight, in particular 15 to 40% by weight, of at least one monomer, or salts thereof, containing carboxyl groups, (c) 0 to 25% by weight, preferably 0 to 15% by weight, of a monomer, or salts thereof, containing sulfonic acid and/or phosphonic acid groups, (d) 0 to 55% by weight, preferably 0 to 40% by weight, of at least one water-soluble nonionic monomer and (e) 0 to 10% by weight, preferably 0 to 5% by weight, of at least one polyethylenically unsaturated monomer in copolymerized form.

Polymers which contain at least one anionic monomer b) or c) can be used without additional anionic emulsifiers or protective colloids. Polymers which contain less than 0.5% of anionic monomers are in most cases used together with at least one anionic emulsifier and/or protective colloid.

Preferred monomers a) are methyl acrylate, ethyl acrylate, n-butyl acrylate, sec-butyl acrylate, tert-butyl acrylate, ethylhexyl acrylate, hydroxyethyl acrylate, hydroxypropyl acrylate, methyl methacrylate, n-butyl methacrylate, (meth) acrylic esters of the perfluoroalkyl-substituted alcohols $CF_3$—$(C_2F_4)_n$—$(CH_2)_m$—OH or $C_2F_5$—$(C_2F_4)_n$—$(CH_2)_m$—OH (n=2–8, m=1 or 2), vinyl acetate, vinyl propionate, styrene, ethylene, propylene, butylene, isobutene, diisobutene and tetrafluoroethylene. Particularly preferred monomers a) are ethyl acrylate, ethyl acrylate, n-butyl acrylate, tert-butyl acrylate and vinyl acetate.

Preferred hydrophobic polymers contain less than 75% by weight of a nonionic water-insoluble monomer (a) in copolymerized form, the homopolymers of which have a glass transition temperature Tg (in the index) of more then 60° C.

Preferred monomers b) are acrylic acid, methacrylic acid, maleic acid or maleic monoesters of $C_1$–$C_8$-alcohols.

Monomers of group (c) are, for example, acrylamido-2-methylpropanesulfonic acid, vinylsulfonic acid, methallylsulfonic acid, vinylsulfonic acid, and the alkali metal and ammonium salts of these monomers.

Suitable monomers d) are, for example, acrylamide, methacrylamide, N-vinylformamide, N-vinylacetamide, N-vinylpyrrolidone, N-vinyloxazolidone, methylpolyglycol acrylate, methylpolyglycol methacrylate and methylpolyglycolacrylamides. Preferred monomers d) are vinylpyrrolidone, acrylamide and N-vinylformamide.

Suitable polyethylenically unsaturated monomers e) are, for example, acrylic esters, methacrylic esters, allyl ethers or vinyl ethers of at least dihydric alcohols. The OH groups of the parent alcohols can be completely or partially etherified or esterified; however, the crosslinkers contain at least two ethylenically unsaturated groups. Examples are butanediol diacrylate, hexanediol diacrylate, trimethylolpropane triacrylate and tripropylene glycol diacrylate.

Further suitable polyethylenically unsaturated monomers e) are, for example, allyl esters of unsaturated carboxylic acids, divinylbenzene, methylenebisacrylamide and divinylurea.

Such copolymers can also be prepared by known methods of solution, precipitation, suspension or emulsion polymerization of the monomers using free-radical polymerization initiators. Preferably, the particulate hydrophobic polymers are obtained by the method of emulsion polymerization in water. The polymers have, for example, molar masses of from 1000 to 2 million, preferably from 5000 to 500,000, and in most cases the molar masses of the polymers are in the range from 10,000 to 150,000.

To limit the molar masses of the polymers it is possible to add customary regulators during the polymerization. Examples of typical regulators are mercapto compounds, such as mercaptoethanol or thioglycolic acid.

Apart from said polymerization processes, other processes for the preparation of the polymer particles to be used according to the invention are also suitable. Thus, it is possible, for example, to precipitate out polymers by lowering the solubility of the polymers in the solvent. Such a method consists, for example, in dissolving a copolymer containing acid groups in a suitable water-miscible solvent, and then metering in water in an excess such that the pH of the initial charge is lower by at least 1 than the equivalent pH of the copolymer. Equivalent pH is understood as meaning the pH at which 50% of the acidic groups of the copolymer have been neutralized. In this process, it may be necessary to add dispersion auxiliaries, pH regulators and/or salts in order to obtain stable finely divided dispersions.

For the modification of finely divided hydrophobic polymers to be used according to the invention which contain anionic groups, it is possible to additionally add, during the dispersion, other polymers which partially or completely react or associate therewith and precipitate out. Such polymers are, for example, polysaccharides, polyvinyl alcohols and polyacrylamides.

Particulate, hydrophobic polymers can also be prepared by emulsifying a melt of the hydrophobic polymers in a controlled manner. For this, the polymer or a mixture of the polymer with further additive is, for example, melted and, under the action of strong shear forces, e.g. in an Ultra-Turrax, water is metered in in an excess such that the pH of the initial charge is lower by at least 1 than the equivalent pH of the polymer. Here, it may in some circumstances be necessary to add emulsifying auxiliaries, pH regulators and/or salts in order to obtain stable finely divided dispersions. In the case of this variant of the preparation of finely divided polymer dispersions too, it is possible to co-use additional polymers such as polysaccharides, polyvinyl alcohols or polyacrylamides, particularly when the hydrophobic polymer contains anionic groups.

A further method for the preparation of finely divided hydrophobic polymers which contain anionic groups consists in treating aqueous, alkaline solutions of the polymers, preferably under the action of strong shear forces, with an acid.

Examples of anionic emulsifiers are anionic surfactants and soaps. Anionic surfactants which may be used are alkyl and alkenyl sulfates, sulfonates, phosphates and phosphonates, alkyl- and alkenylbenzenesulfonates, alkyl ether sulfates and phosphates, saturated and unsaturated C10–C25-carboxylic acids and salts thereof.

Additionally, it is possible to use nonionic and/or betainic emulsifiers. A description of suitable emulsifiers is given, for example, in Houben Weyl, Methoden der organischen Chemie, [Methods of Organic Chemistry] volume XIV/1, Makromolekulare Stoffe [Macromolecular substances], Georg Thieme Verlag, Stuttgart, 1961, pages 192 to 208.

Examples of anionic protective colloids are water-soluble anionic polymers. Here, it is possible to use very different types of polymer. Preference is given to using anionically substituted polysaccharides and/or water-soluble anionic copolymers of acrylic acid, methacrylic acid, maleic acid, maleic monoesters, vinylsulfonic acid, styrenesulfonic acid or acrylamidopropanesulfonic acid with other vinylic monomers. Suitable anionically substituted polysaccharides are, for example, carboxymethylcellulose, carboxymethyl starch, oxidized starch, oxidized cellulose and other oxidized polysaccharides, and the corresponding derivatives of the partially degraded polysaccharides.

Suitable water-soluble anionic copolymers are, for example, copolymers of acrylic acid with vinyl acetate, acrylic acid with ethylene, acrylic acid with acrylamide, acrylamidopropanesulfonic acid with acrylamide or acrylic acid with styrene.

In addition, it is possible to use other nonionic and/or betainic protective colloids. An overview of customarily used protective colloids is given in Houben Weyl, Methoden der organischen Chemie, [Methods of Organic Chemistry], volume XIV/1, Makromolekulare Stoffe [Macromolecular substances], Georg Thieme Verlag, Stuttgart, 1961, pages 411 to 420.

For the preparation of particulate, hydrophobic polymers, use is preferably made of anionic polymeric protective colloids which lead to primary particles having anionic groups on the particle surface.

The cationically modified, particulate, hydrophobic polymers to be used according to the invention are obtainable by coating the surface of anionically dispersed, particulate, hydrophobic polymers with polyvalent metal ions and/or cationic surfactants. A coating of the particles with polyvalent metal ions is achieved by, for example, adding an aqueous solution of at least one water-soluble, polyvalent metal salt to an aqueous dispersion of anionically dispersed hydrophobic polymers, or dissolving a water-soluble, polyvalent metal salt therein. Alternatively, an aqueous solution of at least one water-soluble polyvalent metal salt can also be initially introduced, and an aqueous dispersion of an anionically dispersed hydrophobic polymer added. Suitable metal salts are, for example, the water-soluble salts of Ca, Mg, Ba, Al, Zn, Fe, Cr or mixtures thereof. Other water-soluble heavy metal salts derived, for example, from Cu, Ni, Co and Mn can also in principle be used, but are not desired in all applications. Examples of water-soluble metal salts are calcium chloride, calcium acetate, magnesium chloride, aluminum sulfate, aluminum chloride, barium chloride, zinc chloride, zinc sulfate, zinc acetate, iron(II) sulfate, iron(III) chloride, chromium(III) sulfate, copper sulfate, nickel sulfate, cobalt sulfate and manganese sulfate. Preference is given to using the water-soluble salts of Ca, Al and Zn for the cationization.

Reversing the charge of the anionically dispersed hydrophobic polymers is also possible with cationic surfactants. Potentially suitable for this purpose are cationic surfactants of very differing structure. An overview of the choice of suitable cationic surfactants is given in Ullmann's Encyclopedia of Industrial Chemistry, sixth edition, 1999, Electronic Release, "Surfactants" Chapter, Chapter 8, Cationic Surfactants.

Particularly suitable cationic surfactants are, for example, $C_7$- to $C_{25}$-alkylamines, $C_7$- to $C_{25}$-N,N-dimethyl-N-(hydroxyalkyl)ammonium salts, mono- and di($C_7$- to $C_{25}$-)alkyldimethylammonium compounds quaternized with alkylating agents, ester quats such as, for example, quaternary esterified mono-, di- or trialkanolamines which have been esterified with $C_8$- to $C_{22}$-carboxylic acids, imidazoline quats, such as, for example, 1-alkylimidazolinium salts of the formulae I or II

I

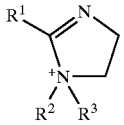

II

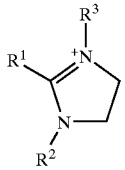

where $R^1$=$C_1$–$C_{25}$-alkyl or $C_2$–$C_{25}$-alkenyl, $R^2$=$C_1$–$C_4$-alkyl or hydroxyalkyl and $R^3$=$C_1$–$C_4$-alkyl, hydroxyalkyl or a radical $R^1$—(C═O)—X—$(CH_2)_n$— where X=O or NH and n=2 or 3, and where at least one radical $R^1$=$C_7$–$C_{22}$-alkyl or $C_7$–$C_{22}$-alkenyl.

For many commercially industrial applications and everyday domestic applications, the modification of the properties of smooth or structured surfaces with dispersions is of importance. It is not always possible to carry out the modification of the surfaces by saturation, spraying or painting processes with concentrated dispersions. It is often desirable to carry out the modification by rinsing the material to be treated with a heavily diluted liquor containing an active substance or by spraying on a heavily diluted aqueous formulation. Here, it is often desirable to combine the modification of the surface of materials in conjunction with a washing, cleaning and/or care or impregnation of the surface. In practice, surfaces of differing materials are suitable, e.g. hard macroscopic surfaces, such as floor and wall coverings, exposed concrete, stone facades, plastered facades, glass surfaces, ceramic surfaces, metal surfaces, enameled surfaces, plastic surfaces, wood surfaces, surfaces of coated woods and painted surfaces, microscopic surfaces, such as porous bodies (e.g. foams, woods, leather, porous construction materials, porous minerals), fibrous structures, such as fiber surfaces in textiles and textile tiles, floor and wall coverings, floor and wall paints or coatings, furniture covers and cellulose fleeces. Preferably treated surfaces are floor and wall coverings made of plastics or ceramic, furniture covers, and objects made of glass and metal. Of the microscopic surfaces, textiles, in particular cotton fabric and cotton blend fabric, carpets and furniture covers preferably require treatment.

The modification of the surfaces can consist, for example, in a hydrophobicization, soil-release finishing, soil-repelling finishing, a reinforcement of the fiber composite and protection against chemical or mechanical influences or damage.

The cationically modified, particulate, hydrophobic polymers are used for the modification of surfaces of the materials mentioned above by way of example, as additive to rinse, care and impregnation compositions, detergents and cleaners. They can, for example, be used as the sole active component in aqueous rinse and care compositions and, depending on the composition of the polymer, facilitate soil release during a subsequent wash, bring about lower soil adhesion upon use, improve the retention of the structure of fibers, improve the retention of shape and structure of fabrics, the effect hydrophobicization of the surface of the ware, and improve the handle. The concentration of the cationically modified, particulate, hydrophobic polymers in the case of use in the rinse or care bath, in the detergent liquor or the cleaning bath is, for example, 0.0002 to 1.0% by weight, preferably 0.0005 to 0.25% by weight, particularly preferably 0.002 to 0.05% by weight.

Compositions for treating laundry, textile surfaces, leather, wood and hard surfaces which comprise the cationically modified particulate hydrophobic polymers can, for example, have the following composition:

(a) 0.05 to 40% by weight of cationally modified particulate hydrophobic polymers the surface of which has been cationically modified by coating with polyvalent metal ions and/or cationic surfactants and the particle size of which is 10 nm to 100 $\mu$m, (b) 0.01 to 20% by weight of at least one water-soluble salt of Ca, Mg, Al, Zn and/or 0.01 to 30% by weight of at least one cationic surfactant, (c) 0 to 80% by weight of at least one customary additive, such as acids or bases, inorganic builders, organic cobuilders, further surfactants, polymeric color transfer inhibitors, polymeric antiredeposition agents, soil release polymers, enzymes, complexing agents, corrosion inhibitors, waxes, silicone oils, light protection agents, dyes, perfume, solvents, hydrotropic agents, salts, thickeners and/or alkanolamines and (d) water to make up to 100% by weight.

The treatment of laundry, textile surfaces, leather, wood and hard surfaces is preferably carried out using aqueous liquors which comprise at least 0.5, mmol/l of water-soluble Ca, Mg or Zn salts and/or at least 0.05 mmol of water-soluble Al salts and/or at least 50 ppm of at least one cationic surfactant.

Laundry aftertreatment and laundry care compositions may be liquid, in gel form or solid.

Liquid or gel compositions can, for example, have the following composition:

(a) 0.1 to 30% by weight of particulate, hydrophobic polymers which contain, in copolymerized form, at least one group of anionic ethylenically unsaturated monomers, which have a paticle size of from 10 nm to 100 $\mu$m and have been dispersed in water, (b) 0.05 to 20% by weight of an acid, (c) 0.1 to 30% by weight of at least one water-soluble salt of Mg, Ca, Zn or Al and/or a cationic surfactant, (d) 0 to 10% by weight of at least one other customary ingredient, such as perfume, further surfactants, silicone oil, light protection agent, dye, complexing agent, antiredeposition agent, soil release polyester, color transfer inhibitor, nonaqueous solvent, hydrotropic agent, thickener and/or alkanolamine and (e) water to make up to 100% by weight.

The liquid or gel laundry aftertreatment and laundry care compositions comprise in a preferred embodiment (a) 0.5 to 25% by weight of particulate, hydrophobic polymers which contain, in copolymerized form, 5 to 45% by weight of an ethylenically unsaturated monomer containing at least one carboxylic acid group, have a particle size of from 10 nm to 100 $\mu$m and which have been dispersed in water using an anionic emulsifier and/or an anionic protective colloid, (b) 0.05 to 10% by weight of at least one acid, (c) 0.1 to 30% by weight of at least one water-soluble salt of Mg, Ca, Zn or Al and/or a cationic surfactant, (d) 0 to 10% by weight of at least one other customary ingredient, such as perfume, further surfactants, silicone oil, light protection agent, dye, complexing agent, antiredeposition agent, soil release polyester, color transfer inhibitor, nonaqueous solvent, hydrotropic agent, thickener and/or alkanolamine and (e) water to make up to 100% by weight.

The compositions of this preferred embodiment are particularly suitable for achieving soil release-promoting properties. Soilings which arise in the service phase can be removed more readily from the laundry aftertreated in this way in the subsequent wash cycle.

The liquid or gel laundry aftertreatment and laundry care compositions comprise, in a further preferred embodiment, (a) 0.5 to 25% by weight of particulate, hydrophobic polymers which contain 75 to 100% by weight of at least one water-insoluble ethylenically unsaturated monomer in copolymerized form, have a particle size of from 10 nm to 100 $\mu$m and are dispersed in water with an anionic emulsifier and/or an anionic protective colloid, (b) 0 to 10% by weight of at least one acid, (c) 0.1 to 30% by weight of at least one water-soluble salt of Mg, Ca, Zn or Al and/or a cationic surfactant, (d) 0 to 10% by weight of at least one other customary ingredient, such as perfume, further surfactants, silicone oil, light protection agents, dye, complexing agent, antiredeposition agent, soil release polyester, color transfer inhibitor, nonaqueous solvent, hydrotropic agent, thickener and/or alkanolamine and (e) water to make up to 100% by weight.

The compositions of this preferred embodiment are particularly suitable for achieving hydrophobicizing or impregnating properties. Water is absorbed or let through to a significantly lesser degree by the laundry aftertreated in this way.

The liquid or gel laundry aftertreatment and laundry care compositions comprise, in a further preferred embodiment, (a) 0.5 to 25% by weight of particulate, hydrophobic polymers which contain in copolymerized form 10 to 100% by weight of at least one ethylenically unsaturated monomer which contains fluorine substituents, have a particle size of from 10 nm to 100 μm and are dispersed in water with an anionic emulsifier and/or an anionic protective colloid, (b) 0 to 10% by weight of at least one acid, (c) 0.1 to 30% by weight of at least one water-soluble salt of Mg, Ca, Zn or Al and/or a cationic surfactant, (d) 0 to 10% by weight of at least one other customary ingredient, such as perfume, further surfactants, silicone oil, light protection agents, dye, complexing agent, antiredeposition agent, soil release polyester, color transfer inhibitor, nonaqueous solvent, hydrotropic agent, thickener and/or alkanolamine and (e) water to make up to 100% by weight.

The compositions of this preferred embodiment are particularly suitable for achieving soil-repelling, in particular oil- and grease soiling-repelling, properties. Oil and grease soiling is absorbed by the fabric aftertreated in this way to a lesser extent.

Suitable acids are mineral acids, such as sulfuric acid or phosphoric acid, or organic acids, such as carboxylic acids or sulfonic acids. Strong acids, such as sulfuric acid, phosphoric acid or sulfonic acids are usually used here in partially neutralized form.

The cationic modification of the particulate, hydrophobic polymers is preferably carried out prior to use in the aqueous treatment compositions, although it can also be carried out during the preparation of the aqueous treatment compositions or the use of anionically emulsified, particulate, hydrophobic polymers having a particle size of from 10 nm to 100 μm by, for example, mixing aqueous dispersions of the suitable particulate polymers with the other constituents of the treatment composition in each case in the presence of water-soluble salts of polyvalent metals and/or cationic surfactants.

In a particular embodiment it is also possible to add the anionic particles or formulations containing these particles directly to the rinse, wash or cleaning liquor if it is ensured that sufficient amounts of polyvalent metal ions and/or cationic surfactants are present in the liquor in dissolved form. For example, it is possible to use the anionic particles or formulations containing these particles in liquors having a content of water-soluble salts of Ca, Mg or Zn of more than 0.5 mmol/l, preferably more than 1 mmol/l, particularly preferably more than 2 mmol/l. For example, it is possible to use the anionic particles or formulations containing these particles in liquors having a content of water-soluble salts of Al of more than 0.05 mmol/l, preferably more than 0.1 mmol/l, particularly preferably more than 0.2 mmol/l. Cationic surfactants are used, for example, in concentrations of from 50 to 100 ppm, preferably 75 to 500 ppm and in particular from 100 to 300 ppm, in the aqueous liquor.

The anionic particles or formulations containing these particles can also be metered in before, after or at the same time as a formulation containing cationic surfactants.

Examples of the composition of typical anionic dispersions which can be processed by mixing with water-soluble salts of polyvalent metals and/or cationic surfactants, and other components to give rinse, care, impregnation, compositions, detergents and cleaners, are the dispersions I to V described below, the dispersed particles of which can in each case be observed, upon investigation using electron microscopy, as discrete particles having the given average particle diameter:

Dispersion I

40% strength by weight aqueous dispersion of a polymer of 56% by weight of ethyl acrylate, 33% by weight of methacrylic acid and 11% by weight of acrylic acid having an average particle diameter of 288 nm. The dispersion comprised 1.25% by weight of an anionic surfactant as emulsifier and 20% by weight of a low molecular weight starch as protective colloid. It had a pH of 4.

Dispersion II

30% strength by weight aqueous dispersion of a polymer of 66% by weight of ethyl acrylate, 4% by weight of methacrylic acid, 26% by weight of acrylic acid and 4% by weight of acrylamide. The average diameter of the dispersed particles of the dispersion was 176 nm. The dispersion comprised 0.8% by weight of an anionic surfactant as emulsifier and had a pH of 4.

Dispersion III

30% strength by weight aqueous dispersion of a polymer of 50% by weight of ethyl acrylate and 50% by weight of methacrylic acid having an average diameter of the dispersed particles of 123 nm. The dispersion comprised 0.8% by weight of an anionic surfactant as emulsifier and had a pH of 4.

Dispersion IV

Anionic fluoropolymer dispersion Nuva® FTA-4 (Clariant)

Dispersion V

35% strength by weight aqueous dispersion of a polymer of 64% by weight of n-butyl acrylate, 32% by weight of methyl methacrylate and 4% by weight of acrylic acid. The average diameter of the dispersed particles of the dispersion was 80 nm. The dispersion comprised 1.5% by weight of an anionic surfactant as emulsifier and had a pH of 6.

From the dispersions I to III it is possible to prepare typical formulations according to the invention having soil-release action which are used, for example, during domestic laundry washing in the afterrinse cycle of the washing machine in a dosage of from 2 to 5 g/l, preferably 3 g/l, Formulation I 50% by weight of one of the dispersions I to III described above 1.5% by weight of formic acid 12% by weight of calcium chloride Water to make up to 100% by weight.

The formulation can optionally comprise further constituents, such as customary soil release polymers for polyesters, antiredeposition agents, perfume, dyes, enzymes, hydrotropic agents, solvents, nonionic surfactants, silicone oil, a textile softener and/or a thickener.

Formulation II

50% by weight of one of the dispersions I to III described above 1.5% by weight of formic acid 12% by weight of calcium chloride 10% by weight of an ester quat (methyl quat of the ditallow fatty acid ester of triethanolamine)

Water to make up to 100% by weight.

Formulation III

50% by weight of one of the dispersions I to III described above

2% by weight of 2N sulfuric acid 1.5% by weight of aluminum sulfate

Water to make up to 100% by weight.

Formulation IV

50% by weight of one of the dispersions I to III described above

2% by weight of 2N sulfuric acid 1.5% by weight of aluminum sulfate

5% by weight of an ester quat (methyl quat of the ditallow fatty acid ester of triethanolamine)

Water to make up to 100% by weight.

The formulation can optionally comprise further constituents, such as customary soil release polymers for polyesters, antiredeposition agents, perfume, dyes, enzymes, hydrotropic agents, solvents, nonionic surfactants, silicone oil, a textile softener and/or a thickener.

Suitable as hydrophobicizing, soil-repelling and fiber-strengthening additive to rinse compositions, care compositions, detergents and cleaners are, for example, the following aqueous dispersions, the dispersed particles of which have an average diameter of from 10 nm to 100 $\mu$m:

copolymers of butyl acrylate and styrene containing anionic dispersant copolymers of butyl acrylate and vinyl acetate containing anionic dispersant tetrafluoroethylene polymers containing anionic dispersant.

The anionic character of the abovementioned dispersions can optionally additionally be established by polymerizing the polymers in the presence of small amounts (up to 10% by weight) of anionic monomers, such as acrylic acid, styrenesulfonic acid, vinylphosphonic acid or acrylamido-2-methylpropanesulfonic acid. These dispersions are preferably initially cationically modified by treatment with water-soluble salts of polyvalent metals or with cationic surfactants, or the cationic modification of the dispersions is carried out during the preparation of the rinse or care compositions, as described above under formulations I to IV. The resulting cationically modified, particulate, hydrophobic polymers to be used according to the invention have, upon use in the afterrinse cycle of the domestic washing machine, a hydrophobicizing, fiber-strengthening and soil-repelling action on the textiles treated therewith.

An example of a suitable formulation for the soil-repelling modification of textiles, textile floor coverings and other materials and surfaces is Formulation V 50% by weight of the dispersion IV described above 5% by weight of formic acid 12% by weight of calcium acetate Water to make up to 100% by weight.

The formulation can be used, for example, in a dilution with water in the weight ratio 1:50 to 1:1 000 for the rinsing or aftertreatment of the abovementioned materials.

An example of a suitable formulation for the hydrophobicization of textiles, wood, leather and other materials and surfaces is Formulation VI 20% by weight of the dispersion V described above 8% by weight of calcium acetate 5% by weight of polyvinylpyrrolidone of molar mass $M_w$ 30 000

Water to make up to 100% by weight.

The formulation can be used, for example, in a dilution with water in the weight ratio 1:20 to 1:5 000 for the rinsing or aftertreatment of the abovementioned materials.

The dispersions I to V can, for example, also be used directly or as a formulation with further constituents in water which has a content of at least 0.5 mol/l of $Ca^{2+}$, $Mg^{2+}$ or $Zn^{2+}$ or at least 0.05 mol/l of $Al^{3+}$.

The invention further provides a liquid or gel cleaning and care formulation which has the following composition:

(a) 0.05 to 30% by weight of cationically modified, particulate, hydrophobic polymers, the surface of which has been cationically modified by coating with polyvalent metal ions and/or cationic surfactants, and the particle size of which is 10 nm to 100 $\mu$m, (b) 0.01 to 40% by weight of at least one nonionic or anionic surfactant, (c) 0.01 to 30% by weight of at least one water-soluble salt of Mg, Ca, Zn or Al and/or a cationic surfactant, (d) 0 to 10% by weight of at least one complexing agent, (e) 0 to 20% by weight of other customary ingredients, such as pH regulators, extenders, further surfactants, thickeners, solvents, hydrotropic agents, polycarboxylic acids, silicones, brighteners, perfume and/or dyes and (f) 0 to 90% by weight of water.

The invention further provides a liquid or gel acidic cleaning formulation having the following composition:

(a) 0.1 to 30% by weight of particulate, hydrophobic polymers which contain, in copolymerized form, at least one group of anionic ethylenically unsaturated monomers, which have a particle size of from 10 nm to 100 $\mu$m and have been dispersed in water, (b) 0.05 to 20% by weight of an acid, (c) 0.1 to 30% by weight of at least one water-soluble salt of Mg, Ca, Zn or Al and/or a cationic surfactant, (e) 0 to 10% by weight of at least one complexing agent, (f) 0 to 20% by weight of other customary ingredients, such as pH regulators, extenders, further surfactants, thickeners, solvents, hydrotropic agents, polycarboxylic acids, silicones, brighteners, perfume and/or dyes and (g) 0 to 90% by weight of water.

Such liquid or gel acidic cleaning formulations comprise in a preferred embodiment (a) 0.5 to 25% by weight of particulate, hydrophobic polymers which contain, in copolymerized form, 25 to 60% by weight of an ethylenically unsaturated monomer containing at least one anionic group, preferably a carboxylic acid group, have a particle size of from 10 nm to 100 μm and which have been dispersed in water using an anionic emulsifier and/or an anionic protective colloid, (b) 0.1 to 40% by weight of at least one nonionic or anionic surfactant, (c) 0.1 to 30% by weight of at least one water-soluble salt of Mg, Ca, Zn or Al and/or a cationic surfactant, (d) 0.1–20% by weight of at least one acid (e) 0 to 10% by weight of at least one complexing agent, (f) 0 to 20% by weight of other customary ingredients, such as pH regulators, extenders, further surfactants, thickeners, solvents, hydrotropic agents, polycarboxylic acids, silicones, brighteners, perfume and/or dyes and (g) 0 to 90% by weight of water.

The formulations of this preferred embodiment are particularly suitable for conferring better soil release in a subsequent cleaning operation on surfaces thus treated. Better soil release is obtained especially where the subsequent cleaning operation is effected using a neutral or alkaline cleaning liquor.

Liquid or gel cleaning formulations comprise in a further preferred embodiment (a) 0.5 to 25% by weight of particulate, hydrophobic polymers which contain, in copolymerized form, 75 to 100% by weight of at least one water-soluble ethylenically unsaturated monomer, have a particle size of from 10 nm to 100 μm and are dispersed in water with an anionic emulsifier and/or an anionic protective colloid, (b) 0.1 to 40% by weight of at least one nonionic or anionic surfactant, (c) 0.1 to 30% by weight of at least one water-soluble salt of Mg, Ca, Zn or Al and/or a cationic surfactant, (d) 0 to 20% by weight of at least one acid, (e) 0 to 10% by weight of at least one complexing agent, (f) 0 to 20% by weight of other customary ingredients, such as pH regulators, extenders, further surfactants, thickeners, solvents, hydrotropic agents, polycarboxylic acids, silicones, brighteners, perfume and/or dyes and (g) 0 to 90% by weight of water.

The formulations of this preferred embodiment are particularly suitable for imparting water-repelling or impregnating properties to the cleaned surfaces. Water is absorbed by the surfaces treated in this way to a lesser extent, water can penetrate through the surface less easily.

Liquid or gel cleaning formulations comprise, in a further preferred embodiment, (a) 0.5 to 25% by weight of particulate, hydrophobic polymers which contain, in copolymerized form, 10 to 100% by weight of at least one ethylenically unsaturated monomer which contains fluorine substituents, have a particle size of from 10 nm to 100 μm and are dispersed in water with an anionic emulsifier and/or an anionic protective colloid, (b) 0.1 to 40% by weight of at least one nonionic or anionic surfactant, (c) 0.1 to 30% by weight of at least one water-soluble salt of Mg, Ca, Zn or Al and/or a cationic surfactant, (d) 0 to 20% by weight of at least one acid, (e) 0 to 10% by weight of at least one complexing agent, (f) 0 to 20% by weight of other customary ingredients, such as pH regulators, extenders, further surfactants, thickeners, solvents, hydrotropic agents, polycarboxylic acids, silicones, brighteners, perfume and/or dyes and (g) 0 to 90% by weight of water.

The formulations of this preferred embodiment are particularly suitable for imparting soil-repelling, in particular oil and grease soiling-repelling, properties to the surface cleaned in this way.

The above-described laundry aftertreatment and care compositions and also the cleaning compositions can be formulated on the basis of the same ingredients also as solid compositions. Examples of possible solid forms are powders, granules and tablets.

To prepare solid compositions, it may be necessary to additionally add extenders, spraying auxiliaries, agglomeration auxiliaries, coating auxiliaries or binders. To ensure the effect and also good dissolution behavior, it may additionally be necessary to add components which aid dissolution, such as readily water-soluble salts, polymeric disintegrants or combinations of acids and hydrogencarbonate.

The surfaces of fabrics, fibers, glass, plastics, metals, wood and ceramics treated with the cationically modified dispersions of hydrophobic polymers to be used according to the invention can, following soiling, be more readily freed from the soiling in a subsequent aqueous washing or cleaning process than the untreated surfaces. Using the cationically modified dispersions to be used according to the invention, a much higher soil release action is achieved, particularly on cotton and cellulose fibers, than with known water-soluble soil release polymers.

The invention further provides liquid or gel care and aftertreatment compositions which are sprayed onto the surfaces and materials to be treated as a heavily diluted aqueous formulation. Such formulations applied by spraying on comprise (a) 0.05 to 15% by weight of cationically modified, particulate, hydrophobic polymers the surface of which has been cationically modified by coating with polyvalent metal ions and/or cationic surfactants and the particle size of which is 10 nm to 100 μm, (b) 0 to 20% by weight of at least one nonionic or anionic surfactant, (c) 0 to 15% by weight of at least one water-soluble salt of Mg, Ca, Zn or Al and/or a cationic surfactant, (d) 0 to 5% by weight of at least one complexing agent, (e) 0 to 10% by weight of other customary ingredients, such as pH regulators, extenders, further surfactants, thickeners, solvents, hydrotropic agents, polycarboxylic acids, silicones, brighteners, perfume and/or dyes and (f) 0 to 99.5% by weight of water.

The invention further provides a solid laundry detergent formulation which comprises (a) 0.05 to 20% by weight of cationically modified, particulate, hydrophobic polymers the surface of which has been cationically modified by coating with polyvalent metal ions and/or cationic surfactants and the particle size of which is 10 nm to 100 μm, (b) 0.1 to 40% by weight of at least one nonionic, cationic and/or anionic surfactant, (c) 0 to 50% by weight of an inorganic builder, (d) 0 to 10% by weight of an organic cobuilder and (e) 0 to 60% by weight of other customary ingredients, such as extenders, enzymes, perfume, complexing agents, corrosion inhibitors, bleaches, bleach activators, bleach catalysts, color transfer inhibitors, antiredeposition agents, soil release polyesters, dyes, dissolution improvers and/or disintegrants.

The invention further provides a liquid or gel laundry detergent formulation which comprises (a) 0.05 to 20% by weight of cationically modified, particulate, hydrophobic polymers the surface of which has been cationically modified by coating with polyvalent metal ions and/or cationic surfactants and the particle size of which is 10 nm to 100 $\mu$m, (b) 0.1 to 40% by weight of at least one nonionic and/or anionic surfactant, (c) 0 to 20% by weight of an inorganic builder, (d) 0 to 10% by weight of an organic cobuilder, (e) 0 to 10% by weight of other customary ingredients, such as soda, enzymes, perfume, complexing agents, corrosion inhibitors, bleaches, bleach activators, bleach catalysts, color transfer inhibitors, antiredeposition agents, soil release polyesters, dyes, nonaqueous solvents, hydrotropic agents, thickeners and/or alkanolamines and (f) 0 to 90% by weight of water.

The surfactants, builders, cobuilders, complexing agents, solvents, color transfer inhibitors, soil release polyesters, bleaches, bleach activators, antiredeposition agents, enzymes, perfumes, solvents, thickeners, oils, waxes, hydrotropic agents, foam-suppressing agents, silicones, brighteners and dyes mentioned in the various formulations can be combined in the scope of the ingredients customarily used in rinse formulations, care formulations, detergent formulations and cleaning formulations. For typical ingredients, reference may be made to the chapter Detergents (part 3, Detergent Ingredients, part 4, Household Detergents and part 5, Institutional Detergents) in Ullmann's Encyclopedia of Industrial Chemistry, Sixth Edition, 2000 Electronic Version 2.0.

Preferred nonionic surfactants are, for example, alkoxylated $C_8$–$C_{22}$-alcohols, such as fatty alcohol ethoxylates and oxo alcohol alkoxylates which have been alkoxylated with 3 to 15 mol of ethylene oxide and optionally additionally with 1 to 4 mol of propylene oxide and/or butylene oxide, and block polymers of ethylene oxide and propylene oxide with a molar mass of from 900 to 12 000 and a weight ratio of ethylene oxide to propylene oxide of from 1 to 20.

Particularly preferred nonionic surfactants are $C_{13}/C_{15}$-oxo alcohol ethoxylates and $C_{12}/C_{14}$-fatty alcohol ethoxylates which have been alkoxylated with 3 to 11 mol of ethylene oxide per mole of alcohol or firstly with 3 to 10 mol of ethylene oxide and then with 1 to 3 mol of propylene oxide per mole of alcohol.

Preferred anionic surfacants are, for example, alkylbenzenesulfonates with linear or branched $C_6$–$C_{25}$-alkyl groups, fatty alcohol and oxo alcohol sulfates with $C_8$–$C_{22}$-alcohols and fatty alcohol or oxo alcohol ether sulfates of $C_8$–$C_{22}$-alcohols which have been ethoxylated with 1 to 5 mol of ethylene oxide per mole of alcohol and have been sulfated on the OH end-group of the ethoxylate.

Preferably, formulations according to the invention are formulated with a low content of anionic surfactant, particularly preferably without anionic surfactants. If anionic surfactants are used in the formulations, ether sulfates are preferably used.

Preferred solvents are alcohols, such as methanol, ethanol, isopropanol, n-butanol, isobutanol, ethylene glycol, diethylene glycol, triethylene glycol, dipropylene glycol, tripropylene glycol and butanediol.

Preferably, only small amounts of, particularly preferably no, solvents are added to the formulations.

Preferred builders are alkali metal carbonates, phosphates, polyphosphates, zeolites and silicates. Particularly preferred builders are zeolite A, zeolite P, phyllosilicates, soda and trisodium polyphosphate.

Preferred complexing agents are nitrilotriacetic acid, methylglycinediacetic acid and ethylenediamine tetraacetate, Preferred cobuilders are acrylic acid homopolymers, acrylic acid/maleic acid copolymers, polyaspartic acid and citric acid. Particularly preferred cobuilders are acrylic acid homopolymers of molar mass 1 500 to 30 000 and acrylic acid/maleic acid copolymers with a molar ratio of the monomers of from 10:1 to 1:2 and molar masses of from 4 000 to 100 000.

Preferred soil release polyesters are polyesters of terephthalic acid, ethylene glycol and polyethylene glycol, where polyethylene glycols with molar masses of from 1 000 to 5 000 are incorporated by condensation, and also those polyesters in which terephthalic acid is replaced in an amount up to 50 mol % by sulfocarboxylic acids or sulfodicarboxylic acids.

Preferred color transfer inhibitors are polyvinylpyrrolidone of molar masses 8 000 to 70 000, vinylimidazole/vinylpyrrolidone copolymers with a molar ratio of the monomers of from 1:10 to 2:1 and molar masses of from 8 000 bis 70 000, and poly-4-vinylpyridine N-oxides of molar masses from 8 000 to 70 000.

Preferred enzymes are proteases, lipases, cellulases and amylases.

Formulations according to the invention can optionally additionally comprise further protective colloids for stabilizing the disperse state. This is of particular importance particularly for liquid formulations in order to prevent coagulation. The protective colloids can, however, also advantageously be added to solid formulations in order to prevent coagulation upon use.

Protective colloids which may be used are water-soluble polymers, in particular water-soluble nonionic polymers. Suitable protective colloids preferably have molar masses of from 800 to 200 000, particularly preferably from 5 000 to 70 000, in particular from 10 000 to 50 000.

Suitable protective colloids are, for example, polyvinylpyrrolidone, polyethylene glycol, block polymers of ethylene oxide and propylene oxide, enzymatically degraded starches and polyacrylamides.

The percentages in the examples are percentages by weight.

EXAMPLES

For the examples and comparative examples, the anionic dispersions I and IV were used.

Anionic Dispersion I

40% strength by weight aqueous dispersion of a polymer of 56% by weight of ethyl acrylate, 33% by weight of methacrylic acid and 11% by weight of acrylic acid having an average particle diameter of 288 nm. The dispersion comprised 1.25% by weight of an anionic surfactant as emulsifier and 20% by weight of a low molecular weight starch as protective colloid. It had a pH of 4.

Anionic Dispersion IV

Anionic fluoropolymer dispersion Nuva FTA-4 (Clariant)

Comparative Example 1

The anionic dispersion I was brought to a content of 0.040% using deionized water of pH 4. A white cotton fabric was suspended in the magnetically stirred liquor for 30 min. The absorbance of the liquor was measured using a vis-spectrometer at 520 nm. Over the course of 30 min, no change in the absorbance was observed. Elecron micrographs showed virtually no coating of the cotton fibers with dispersion particles.

Example 1

The anionic dispersion I was brought to a content of particles of 10% by weight using deionized water of pH 4. At pH 4, this dispersion was metered in, with stirring with a magnetic stirrer, to an equal volume of a 50 mmolar solution of $CaCl_2$, pH4, over the course of 30 minutes. This gave a dispersion which was stable for hours. This dispersion was diluted to a content of 0.040% with 1 mmol of Ca2+-containing water of pH 4. A white cotton fabric was suspended in the magnetically stirred liquor for a period of 30 min. The absorbance of the liquor was measured at 520 nm over 30 minutes using a vis-spectrometer. A considerable decrease in the absorbance was observed.

The anionic dispersion I was brought to a content of 0.040% using 3 mmol of Ca 2+-containing water of pH 4. A white cotton fabric was suspended in the magnetically stirred liquor for 30 min. The absorbance of the liquor was measured at 520 nm using a vis-spectrometer. Over the course of 30 min, a considerable decrease in the absorbance was observed.

Example 3

The anionic dispersion I was brought to a content of 0.040% using 3 mmol of Zn 2+-containing water of pH 4. A white cotton fabric was suspended in the magnetically stirred liquor for 30 min. The absorbance of the liquor was measured at 520 nm using a vis-spectrometer. Over the course of 30 min, a considerable decrease in the absorbance was observed.

Example 4

The anionic dispersion I was brought to a content of 0.040% using 3 mmol of Al 3+-containing water of pH 4. A white cotton fabric was suspended in the magnetically stirred liquor for 30 min. The absorbance of the liquor was measured at 520 nm using a vis-spectrometer. Over the course of 30 min, a considerable decrease in the absorbance was observed.

TABLE 1

Absorbance of the dispersions measured at 520 nm in a 1 cm cell. The values give the absorbance of the diluted dispersion prior to immersion of the cotton fabric and after 30 minutes.

| Measurement time point | Comparative Example 1 | Example 1 | Example 2 | Example 3 | Example 4 |
|---|---|---|---|---|---|
| t = 0 min | 1.0 | 0.99 | 0.99 | 1.00 | 1.04 |
| t = 30 min | 1.0 | 0.84 | 0.74 | 0.75 | 0.72 |

The comparison of examples 1 to 4 with the comparative example 1 shows that where a polyvalent metal cation is used as retention auxiliary, considerably higher proportions of the hydrophobic particles are adsorbed on the surface than in the absence of the retention auxiliary.

Examples 5 and 6 and Comparative Examples 2 to 4

To test the soil release properties of afterrinse formulations containing particles to be used according to the invention, the following washing experiments were carried out:

Cotton fabric was prewashed using the anionic dispersion I. In Comparative Experiment 3, the dispersion was used in the absence of polyvalent metal salt and cationic surfactant. In example 5, Ca acetate was added to the dispersion prior to washing. In example 6, ester quat (methyl quat of the ditallow fatty ester of triethanolamine) was added as cationic surfactant to the dispersion prior to washing. The prewashed fabrics were soiled with lipstick composition and then washed using a standard detergent (Ariel Futur). To evaluate the soil release action, the reflectance of the soiled fabric was measured before and after washing, and from this, together with the reflectance value of the white cotton fabric, the soil release was determined in % soil release in a known manner.

Washing Conditions:

Prewash

Washing device: Launder-O-meter

Prewash temperature: 20° C.

Prewash time: 15 min

Main Wash:

Wash temperature: 40° C.

Wash time: 30 min

Water hardness: 3 mmol/l

Ca/Mg ratio: 3:1

TABLE 2

Washing results:

| | Comparative Example 2 | Comparative Example 3 | Comparative Example 4 | Example 5 | Example 6 |
|---|---|---|---|---|---|
| Concentration of particles from dispersion I in the prewash | 0 | 400 mg/l | 0 | 400 mg/l | 400 mg/l |
| Concentration of Ca acetate in the prewash | 0 | 0 | 0 | 3.0 mmol/l | 0 |
| Concentration of cationic surfactant in the prewash | 0 | 0 | 400 mg/l | 0 | 400 mg/l |
| Soil release action in the subsequent wash in % soil release | 35% | 32% | 36% | 58% | 49% |

The results of the washing experiments show that neither the anionic polymer dispersion alone nor the cationic surfacant alone have a soil release action on the soiling. By contrast, the combination according to the invention of Ca salt or cationic surfactant with the anionic polymer dispersion displays a significant improvement in the soil release from cotton.

Example 7 and Comparative Examples 5 and 6

To test the soil-repelling properties of cotton fabrics which had been achieved with afterrinse formulations according to the invention, washing experiments were carried out in a Launder-O-meter.

Cotton fabric was washed with a standard commercial detergent and, in the afterrinsing, afterrinsed with hard water which contained the fluoropolymer dispersion IV. In the comparative experiment 5, no dispersion was added to the afterrinse bath. In the comparative experiment 6, deionized water which contained the fluoropolymer dispersion IV was used in the afterrinse cycle.

The afterrinsed fabrics were spun, dried and ironed. To test the soil-repelling action, each fabric was laid flat over the opening of a beaker with a diameter of 5 cm. One drop of dirty engine oil was then applied in the center. In each case after 10 sec, 180 min and 1 d, it was checked whether the oil drop had penetrated into the fabric.

Washing Conditions:

Main Wash

Detergent: Ariel Futur
Detergent dose: 3.5 g/l
Wash time: 30 min
Wash temperature: 40° C.
Water hardness: 3 mmol
Ca/Mg ratio: 3:1
Liquor ratio: 12.5

Afterrinsing

Afterrinse temperature: 20° C.
Afterrinse time: 15 min
pH: 4
Liquor ratio: 25

TABLE 3

| | Washing results | | |
|---|---|---|---|
| | Comparative example 5 | Comparative example 6 | Example 7 |
| Concentration of particles from dispersion IV in the afterrinse | 0 | 400 ppm | 400 ppm |
| Concentration of Ca acetate in the afterrinse | 3.0 mmol/l | 0 | 3.0 mmol/l |
| Residence time of the oil drop on the cotton fabric | <<10 sec | <10 sec | >1 d |

The results of the washing experiments show that a repellency of the oil soiling cannot be observed either in the absence of the dispersion IV with the addition of polyvalent metal ions, nor in the presence of the dispersion IV in deionized water. By contrast, excellent repellency of the oil soiling can be observed when using the dispersion IV in the presence of 3.0 mmol of $Ca^{2+}$ ions.

We claim:

1. A composition for the treatment of laundry, textile surfaces, leather, wood and hard surfaces, which comprises (a) 0.05 to 40% by weight of cationically modified, particulate, hydrophobic polymers, the surface of which has been cationically modified by coating with at least one of a polyvalent metal ion and a cationic surfactant, and the particle size of which is 10 nm to 100 μm, (b) 0.01 to 20% by weight of at least one of a water-soluble salt of Ca, Mg, Al, and Zn, and 0.01 to 30% by weight of at least one cationic surfactant, (c) 0 to 80% by weight of at least one additive, selected from the group consisting of acids, bases, inorganic builders, organic cobuilders, surfactants, polymeric color transfer inhibitors, polymeric antiredeposition agents, soil release polymers, enzymes, complexing agents, corrosion inhibitors, waxes, silicone oils, light protection agents, dyes, solvents, hydrotropic agents, thickeners and alkanolamines; and (d) water to make up to 100% by weight.

2. The composition as claimed in claim 1, wherein the composition comprises at least 0.5 mmol/l of at least one water-soluble salt of Ca Mg, or Zn, and at least 0.05 mmol/l of water-soluble salt of Al, and at least at least 50 ppm of at least one cationic surfactant.

3. A liquid or gel laundry aftertreatment and laundry care composition which comprises (a) 0.1 to 30% by weight of particulate, hydrophobic polymers which contain, in copolymerized form, at least one group of anionic ethylenically unsaturated monomers, which have a particle size of from 10 nm to 100 μm and have been dispersed in water, (b) 0.05 to 20% by weight of an acid, (c) 0.1 to 30% by weight of at least one of a water-soluble salt of Mg, Ca, Zn or Al and a cationic surfactant, (d) 0 to 10% by weight of at least one ingredient, selected from the group consisting of perfume, silicone oil, light protection agent, dye, complexing agent, antiredeposition agent, soil release polyester, color transfer inhibitor, nonaqueous solvent, hydrotropic agent, thickener and alkanolamine; and (e) water to make up to 100% by weight.

4. A liquid or gel laundry aftertreatment and laundry care composition which comprises (a) 0.5 to 25% by weight of particulate, hydrophobic polymers which contain, in copolymerized form, 25 to 60% by weight of an ethylenically unsaturated monomer containing at least one carboxylic acid group, have a particle size of from 10 nm to 100 μm and which have been dispersed in water using at least one of an anionic emulsifier and an anionic protective colloid, (b) 0.05 to 10% by weight of at least one acid, (c) 0.1 to 30% by weight of at least one of a water-soluble salt of Mg, Ca, Zn or Al and a cationic surfactant, (d) 0 to 10% by weight of at least one ingredient, selected from the group consisting of perfume, silicone oil, light protection agent, dye, complexing agent, antiredeposition agent, soil release polyester, color transfer inhibitor, nonaqueous solvent, hydrotropic agent, thickener and alkanolamine; and (e) water to make up to 100% by weight.

5. A liquid or gel laundry aftertreatment and laundry care composition which comprises (a) 0.5 to 25% by weight of particulate hydrophobic polymers which contain, in copolymerized form, 75 to 100% by weight of at least one water-soluble ethylenically unsaturated monomer or 10 to 100% by weight of an ethylenically unsaturated monomer containing fluorine substituents, have a particle size of from 10 nm to 100 μm and are dispersed in water with at least one of an anionic emulsifier and an anionic protective colloid, (b) 0 to 10% by weight of at least one acid, (c) 0.1 to 30% by weight of at least one of a water-soluble salt of Mg, Ca, Zn or Al and a cationic surfactant, (d) 0 to 10% by weight of at least one ingredient, selected from the group consisting of perfume, surfactants, silicone oil, light protection agent, dye, complexing agent, antiredeposition agent, soil release polyester, color transfer inhibitor, nonaqueous solvent, hydrotropic agent, thickener and alkanolamine; and (e) water to make up to 100% by weight.

6. A liquid or gel cleaning and care formulation which comprises (a) 0.05 to 30% by weight of cationically modified, particulate, hydrophobic polymers, the surface of which has been cationically modified by coating with at least one of a polyvalent metal ion and a cationic surfactant, and the particle size of which is 10 nm to 100 $\mu$m, (b) 0.01 to 40% by weight of at least one nonionic or anionic surfactant, (c) 0.01 to 30% by weight of at least one of a water-soluble salt of Mg, Ca, Zn or Al and a cationic surfactant, (d) 0 to 10% by weight of at least one complexing agent, (e) 0 to 20% by weight of at least one ingredient, selected from the group consisting of pH regulators, extenders, thickeners, solvents, hydrotropic agents, polycarboxylic acids, silicones, brighteners, perfume and dyes; and (f) 0 to 90% by weight of water.

7. A liquid or gel acidic cleaning formulation which comprises (a) 0.1 to 30% by weight of particulate, hydrophobic polymers which contain, in copolymerized form, at least one group of anionic ethylenically unsaturated monomers, which have a particle size of from 10 nm to 100 $\mu$m and have been dispersed in water, (b) 0.05 to 20% by weight of an acid, (c) 0.1 to 30% by weight of at least one of a water-soluble salt of Mg, Ca, Zn or Al and a cationic surfactant, (e) 0 to 10% by weight of at least one complexing agent, (f) 0 to 20% by weight of at least one ingredient, selected from the group consisting of pH regulators, extenders, thickeners, solvents, hydrotropic agents, polycarboxylic acids, silicones, brighteners, perfume and dyes; and (g) 0 to 90% by weight of water.

8. A liquid or gel acidic cleaning formulation which comprises (a) 0.5 to 25% by weight of particulate, hydrophobic polymers which contain, in copolymerized form, 25 to 60% by weight of an ethylenically unsaturated monomer containing at least one carboxylic acid group, have a particle size of from 10 rim to 100 $\mu$m and which have been dispersed in water using at least one of an anionic emulsifier and an anionic protective colloid, (b) 0.1 to 40% by weight of at least one nonionic or anionic surfactant, (c) 0.1 to 30% by weight of at least one of a water-soluble salt of Mg, Ca, Zn or Al and a cationic surfactant, (d) 0.1 –20% by weight of at least one acid (e) 0 to 10% by weight of at least one complexing agent, (f) 0 to 20% by weight of at least one ingredient, selected from the group consisting of pH regulators, extenders, thickeners, solvents, hydrotropic agents, polycarboxylic acids, silicones, brighteners, perfume and dyes; and (g) 0 to 90% by weight of water.

9. A liquid or gel cleaning formulation which comprises (a) 0.5 to 25% by weight of particulate, hydrophobic polymers which contain, in copolymerized form, 75 to 100% by weight of at least one water-soluble ethylenically unsaturated monomer or 10 to 100% by weight of an ethylenically unsaturated monomer containing fluorine substituents, have a particle size of from 10 mn to 100 $\mu$m and are dispersed in water with an anionic emulsifier and an anionic protective colloid, (b) 0.1 to 40% by weight of at least one nonionic or anionic surfactant, (c) 0.1 to 30% by weight of at least one of a water-soluble salt of Mg, Ca, Zn or Al and a cationic surfactant, (d) 0 to 20% by weight of at least one acid, (e) 0 to 10% by weight of at least one complexing agent, (f) 0 to 20% by weight of at least one ingredient, selected from the group consisting of pH regulators, extenders, surfactants, thickeners, solvents, hydrotropic agents, polycarboxylic acids, silicones, brighteners, perfume and dyes; and (g) 0 to 90% by weight of water.

10. A liquid or gel care and aftertreatment composition which comprises (a) 0.05 to 15% by weight of cationically modified particulate, hydrophobic polymers the surface of which has been cationically modified by coating with at least one of a polyvalent metal ion and a cationic surfactant, and the particle size of which is 10 mn to 10 $\mu$m, (b) 0 to 20% by weight of at least one nonionic, cationic and anionic surfactant, (c) 0 to 15% by weight of at least one of a water-soluble salt of Mg, Ca, Zn or Al and a cationic surfactant, (d) 0 to 5% by weight of at least one complexing agent, (e) 0 to 10% by weight of at least one ingredient, selected from the group consisting of pH regulators, extenders, thickeners, solvents, hydrotropic agents, polycarboxylic acids, silicones, brighteners, perfume and dyes; and (f) 0 to 99.5% by weight of water.

11. A solid detergent formulation which comprises (a) 0.05 to 20% by weight of cationically modified, particulate, hydrophobic polymers, the surface of which has been cationically modified by coating with at least one of a polyvalent metal ion and a cationic surfactant, and the particle size of which is 10 nm to 100 $\mu$m, (b) 0.1 to 40% by weight of at least one nonionic, cationic and anionic surfactant, (c) 0 to 50% by weight of an inorganic builder, (d) 0 to 10% by weight of an organic cobuilder, (e) 0 to 60% by weight of at least one ingredient, selected from the group consisting of extenders, enzymes, perfume, complexing agents, corrosion inhibitors, bleaches, bleach activators, bleach catalysts, color transfer inhibitors, antiredeposition agents, soil release polyesters, dyes, dissolution improvers and disintegrants.

12. A liquid or gel detergent formulation which comprises (a) 0.05 to 20% by weight of cationically modified, particulate, hydrophobic polymers, the surface of which has been cationically modified by coating with at least one of a polyvalent metal ion and a cationic surfactant, and the particle size of which is 10nm to 100 $\mu$m, (b) 0.1 to 40% by weight of at least one nonionic, cationic and anionic surfactant, (c) 0 to 20% by weight of an inorganic builder, (d) 0 to 10% by weight of an organic cobuilder, (e) 0 to 10% by weight of at least one ingredient, selected from the group consisting of soda, enzymes, perfume, complexing agent, corrosion inhibitors, bleaches, bleach activators, bleach catalysts, color transfer inhibitors, antiredeposition agents, soil release polyesters, dyes, nonaqueous solvents, hydrotropic agents, thickeners and alkanolamines; and (f) 0 to 90% by weight of water.

13. A method of treatment, aftertreatment, care, and cleaning, comprising:

treating a surface or a textile by contacting the surface or the textile with a mixture comprising one or more cationically modified particulate, hydrophobic polymers having a cationically modified surface, wherein the cationically modified particulate, hydrophobic polymers are obtained by coating one or more particulate hydrophobic polymers with at least one polyvalent metal ion, cationic surfactants or mixtures thereof, wherein the particle size of the particulate, hydrophobic polymers is from 10 rim to 100 $\mu$m.

14. The method as claimed in claim 13, wherein the cationically modified particulate hydrophobic polymers are obtained by treating an aqueous dispersion of the particulate, hydrophobic polymers with an aqueous solution of at least one polyvalent metal salt, an aqueous solution of at least one cationic surfactant or mixtures thereof.

15. The method of claim 14, wherein the aqueous dispersion comprises an anionic emulsifier, an anionic protective colloid or a mixture thereof.

16. The method of claim 13, wherein the particulate, hydrophobic polymers comprise at least one copolymerized anionic monomer.

17. The method of claim 13, wherein the mixture is a 0.1% strength by weight aqueous dispersion of the cationically modified particulate, hydrophobic polymers having an interface potential of from −5 to +50 mV.

18. The method of claim 13, wherein the mixture is an aqueous dispersion of the cationically modified particulate, hydrophobic polymers having a pH of from 2 to 12.

19. The method of claim 14, wherein the cationically modified particulate, hydrophobic polymers are obtained by coating at least one particulate, hydrophobic polymer with at least one polyvalent metal salt, wherein the metal salt is a water-soluble salt of a metal selected from the group consisting of Ca, Mg, Al, Zn and mixtures thereof.

20. The method of claim 13, wherein the cationically modified particulate, hydrophobic polymers are present in an amount of from 0.0002 to 1.0% by weight.

21. The method of claim 13, wherein the cationically modified particulate, hydrophobic polymers are present in an amount of from 0.002 to 0.05% by weight.

* * * * *